United States Patent [19]

Kleinman

[11] 4,242,971

[45] Jan. 6, 1981

[54] DISPLAY TABLE

[76] Inventor: Edward B. Kleinman, 1675 E. Churchill Downs, Germantown, Tenn. 38138

[21] Appl. No.: 36,651

[22] Filed: May 7, 1979

[51] Int. Cl.[3] ..... A47B 85/00

[52] U.S. Cl. ..... 108/26; 108/50; 108/94; 108/150

[58] Field of Search ..... 108/25, 26, 94, 95, 108/104, 150, 20, 50; D6/85

[56] References Cited

U.S. PATENT DOCUMENTS

| | | | |
|---|---|---|---|
| 887,716 | 5/1908 | Xander | 108/94 |
| 1,354,735 | 10/1920 | Ferrell | 108/94 |
| 1,627,130 | 5/1927 | Vogler | 108/20 |
| 1,652,792 | 12/1927 | Nagy | 108/94 X |
| 1,754,094 | 4/1930 | Glass, Sr. | 108/94 |
| 3,055,721 | 9/1962 | Holt | 108/150 X |
| 3,636,299 | 1/1972 | Stewart, Jr. | 108/94 X |

*Primary Examiner*—Roy D. Frazier
*Assistant Examiner*—Peter A. Aschenbrenner
*Attorney, Agent, or Firm*—Lowe, King, Price and Becker

[57] ABSTRACT

A merchandise display table which allows a plurality of customers to simultaneously select and view a plurality of eyeglass frames has a pedestal, a multi-sided mirror vertically mounted atop the pedestal, an annular table member disposed about the pedestal including an annular track, and an annular compartmented display tray disposed within the annular track and arranged for rotation about the annular table member. The periphery of the table member has a plurality of customer seating stations, each station facing one side of the multi-sided mirror.

22 Claims, 4 Drawing Figures

DISPLAY TABLE

FIELD OF THE INVENTION

The present invention relates generally to display tables and more particularly to an eyeglass frame display table having a plurality of seating stations disposed opposite a multi-sided mirror and a rotatable multi-compartmented merchandise display tray.

BACKGROUND OF THE INVENTION

It has generally been the practice of optometrists, opthamologists, opticians, and optical technicians to dispense and fit eyeglass frames at a small, rectangular fitting table where a person doing the dispensing sits opposite a patient or customer during the selection while adjusting eyeglass frames for proper style and fit. A small mirror is usually provided at the table to enable the customer to see the effect of various frame styles on his appearance. Necessarily, such dispensing tables provide little room for an attractive display of available frames, often numbering in the hundreds. Usually, the customer must either trust to the judgment of the dispensing person to select an appropriate frame style or the customer and dispenser must search through a large number of frames contained in a rack or drawer, which may be remote from the fitting table and may or may not be arranged in any particular order. With the increasing popularity of boutique type of eyeglass dispensing establishments, a large number of customers and large selection of eyeglass frames must be simultaneously accommodated.

Merchandise display tables and racks of various types are well known in the art. In U.S. Pat. No. Des. 100,302 there is disclosed a display table having a plurality of counters annularly arranged about a central, vertically disposed display case. Display shelves appear to be located behind glass doors at each of a plurality of customer displaying stations. The structure disclosed in U.S. Pat. No. Des. 100,302, however, does not appear to be particularly well suited to the purpose of dispensing eyeglass frames because customers cannot readily look at themselves to see the effect of frames on their appearance.

Another display table, shown in U.S. Pat. No. 3,980,027 includes an annular, compartmented display tray rotatably disposed about a central pedestal and base. The structure disclosed in U.S. Pat. No. 3,980,027 is not adapted for use in connection with displaying and merchandising eyeglass frames because a customer cannot readily see himself.

There is no convenient structure for holding a relatively large number of eyeglass frames, in either of the previously mentioned patents.

Other types of multi-sided display racks or cabinets are shown in U.S. Pat. No. 3,942,674, as well as U.S. Pat. Nos. Des. 66,553; 65,640; and 33,998. The structures disclosed in these patents are not suitable for dispensing and displaying a large number of relatively expensive eyeglass frames, which are to be fitted on a customer by dispensing personnel for various reasons. Generally, no means is provided to enable a customer to select a large number of frames and to determine immediately whether the frame is suitable for his face. In addition, sufficient space is generally not provided to enable the dispensing person to be seated with the customer, nor is sufficient room provided to enable optical instruments to be placed on the dispensing rack or cabinet.

It is, therefore, an object of the present invention to provide a new and improved merchandise display table where several customers can be simultaneously seated and fitted with eyeglass frames.

A further object of the invention is to provide a new and improved merchandise display table where eyeglass frames are readily accessible to customers simultaneously seated around the periphery of the table, and which enables the customer to readily determine the appearance of the eyeglass frames on his face.

An additional object of the present invention is to provide a new and improved fitting and display table for eyeglass frames, wherein customers can be readily seated simultaneously around the periphery of the table and sufficient room is provided at the table to enable fitting personnel to work with the customer and to have space for optical instruments utilized in conjunction with eye examinations.

Another object of the invention is to provide a new and improved eyeglass frame fitting and display table which is easily assembled and attractive in appearance.

SUMMARY OF THE INVENTION

These and other objects are achieved in accordance with the present invention by providing a merchandise display table including a pedestal on which is mounted a multi-sided mirror and an annular platform at which the customer sits in facing relationship with the mirror unit. The annular table includes an annular track or groove in which is located an annular compartmented display table that is rotated about a vertically extending axis of the pedestal, mirror unit, and platform. The platform periphery is formed as a regular polygon, each side of which has sufficient length to define a customer seating station. Each side of the regular polygon extends in a direction parallel to a side of the mirror unit, which is also a regular polygon that is geometrically similar to the platform polygon. Mounted at fixed positions in the annular groove are a plurality of bearings that fit in raceways on the bottom face of the tray. The bearings are mounted in the groove in such a way as to provide the synergistic effect of insuring smooth rotation of the annular tray with respect to the platform, while providing sufficient drag to prevent high speed rotation of the tray. High speed rotation of the tray is to be avoided because it may impart sufficient centrifugal force to eyeglass frames located in the tray to cause the frames to move radially outward from the center of the tray, thereby increasing the probability of dislodging the frames from the tray and adversely affecting the appearance of the frames.

In use, each customer is seated directly across from one side of the mirror unit, along one side of the platform, thereby allowing the customer to view the selected frames on his face. The rotatable, compartmented tray enables a very large number of frames to be conveniently, attractively and simultaneously displayed, while allowing individual customers ready access to any frame simply by rotating the tray to bring the desired compartment opposite the seating position of the customer.

The above and still further objects, features and advantages of the present invention will become apparent upon consideration of the following detailed description of one specific embodiment thereof, especially when taken in conjunction with the accompanying drawings.

DETAILED DESCRIPTION OF THE PREFERRED EMBODIMENT

Figure 1:
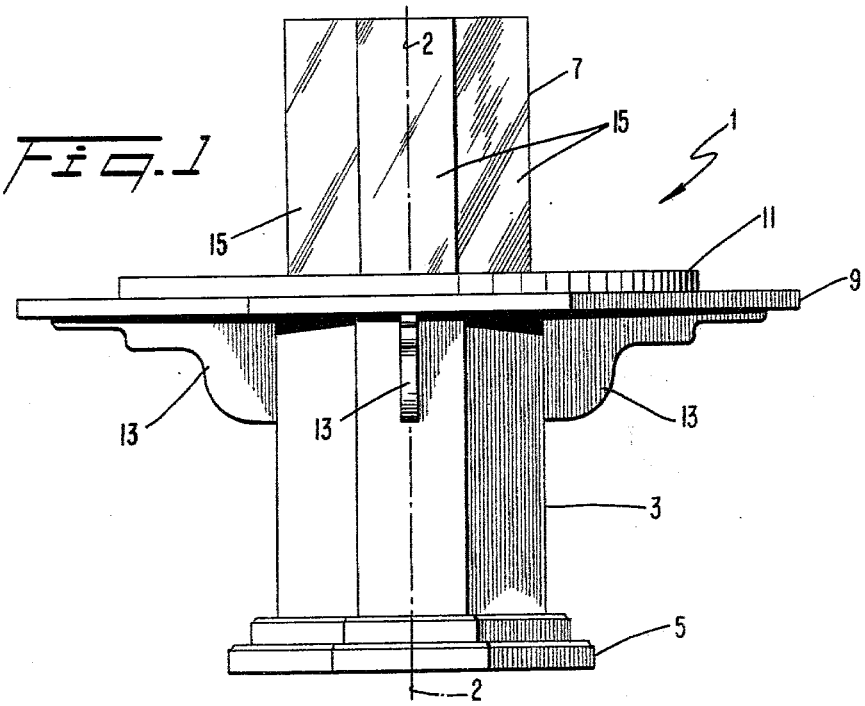
FIG. 1 is a side view of a display table in accordance with the principles of the preferred embodiment of the invention.
Figure 2:
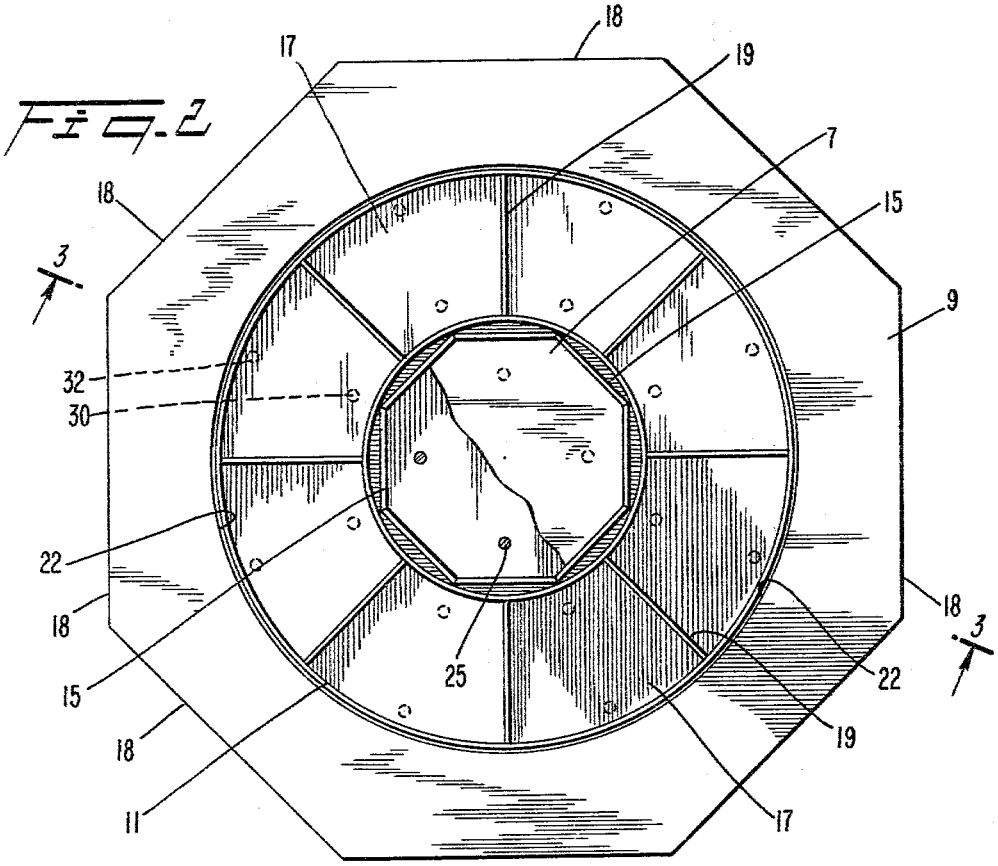
FIG. 2 is a top view of the display table illustrated in FIG. 1.

Reference is now made to the Figures wherein table 1 is illustrated as including a vertical axis 2 about which is located a symmetrical structure including pedestal 3 that is fixedly and concentrically mounted to base 5. Base 5 includes a relatively wide, stabilizing collar 4 at floor level, and a narrower collar 6 that is secured to the top of collar 4 and to the sides of pedestal 3 to add strength to and support for the relatively massive weight and large cantilevered structure of the table. A multi-sided vertical extending mirror unit 7, formed as a regular octagon, in horizontal cross-section, is fixedly mounted atop pedestal 3. Annular platform 9, horizontally mounted about an upper portion of pedestal 3, is fixed to the pedestal by four supporting and decorative arms 13 having vertical edges fixedly secured to vertical faces of alternate flat sides of pedestal 3 and upper, horizontal edges fixedly secured to the bottom face of platform 9. Annular tray member 11 is rotatably mounted atop platform 9 so it is concentric with axis 2.

The outer periphery of platform 9 is formed as a regular octagon including sides or edges 18 that are parallel to the faces of flat faces included in mirror unit 7. Each of sides 18 defines a customer seating station. In the preferred embodiment, platform 9 and mirror unit 7 are regular octagons, but is to be understood that they may have any suitable number of equal length sides.

Mirror unit 7 includes eight vertically extending planar mirrors 15, each of which is parallel to one of sides 18 so that each seating position is associated with a different mirror to enable a customer sitting at each station to see himself readily and to provide a dispensing operator (technician, optometrist, or opthamologist) with sufficient space to sit next and assist in fitting eyeglass frames on the customer, as well as to provide adequate room for optical instruments, such as a pupilometer. Each of the eight mirrors has beveled vertical edges so that adjacent mirrors have abutting edges bonded to each other to form mirror unit 7.

Annular tray member 11 includes a plurality of compartmented tray sections 17, each having the same geometry. Each section 17 is a sector of annular tray member 11 and is separated from adjoining tray sections by radially extending walls 19. The number of compartmented tray sections is preferably equal to the number of sides of platform 9 so that each customer can consider all of the frames in an individual tray section at one time and the frames at each station are separated from each other, to prevent customers sitting at adjacent stations from taking the frames from a neighboring station. Tray sections 17 are dimensioned to receive eyeglass frames to be displayed and merchandised, and may include suitable support, racks or the like. The bottom of each tray section 17 can be covered with a soft, resilient covering, if desired.

Between the outer edges of tray sections 17 and each of sides 18 is formed a display space, where customers sitting at each station may place glasses that have been selected for consideration and where optical instruments can be placed. The inner diameter of tray 11 is slightly greater than the distance between opposite corners of mirror unit 7 so that the tray can be put on platform 9 by initially locating the tray above the top of mirror unit 7 and then lowering the tray around the mirror unit, and so the tray can turn about the mirror unit. The outer diameter of tray 11 is relatively large, enabling many frames to be stored in each of sections 17. In a preferred embodiment, the inner and outer diameters of tray 11 are approximately two feet and four feet, respectively. Because of the straight edges of platform 9, which are parallel to the straight faces of mirrors 15 in the horizontal cross-sectional plane, the customer can sit relatively close to the mirror in a chair at a particular station and adequate room is provided to place glasses and other objects at the station. Each of support arms 13 is positioned so that the legs of the customers sitting at alternate stations can easily straddle the support leg.

Figure 3:
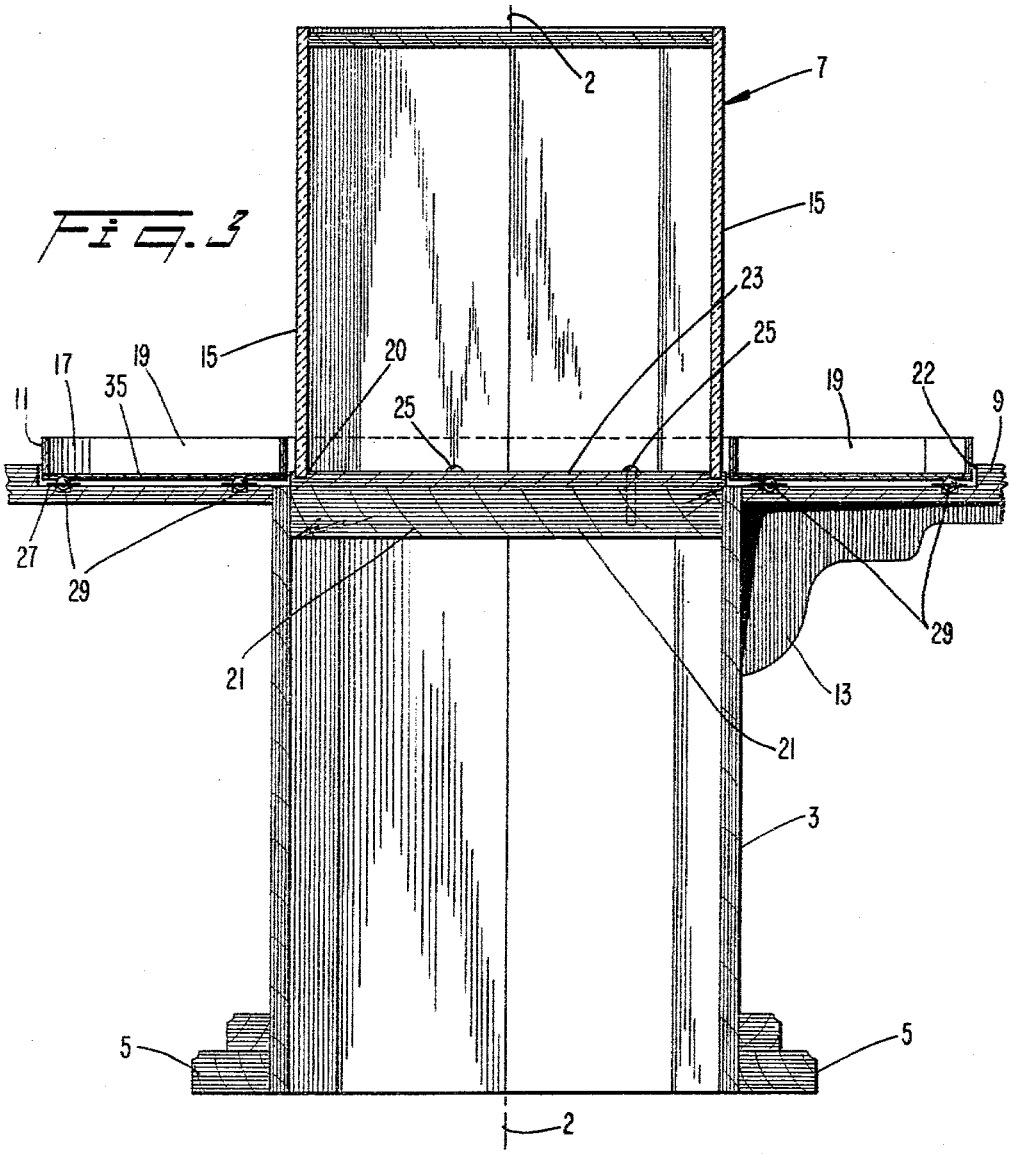
FIG. 3 is a side sectional view of the display table, taken along the lines 3—3 of FIG. 2.
Figure 4:
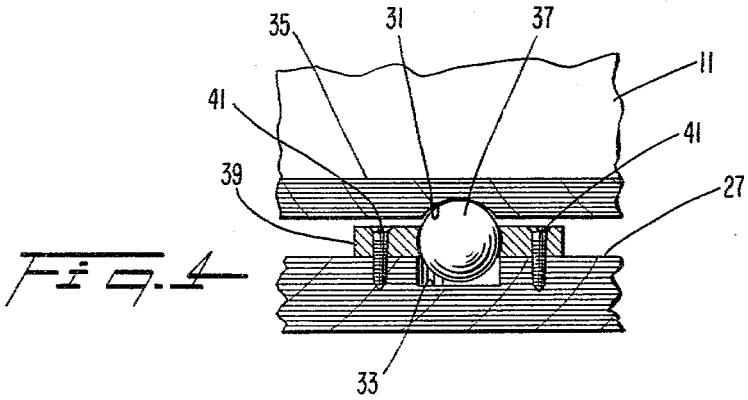
FIG. 4 is a sectional view of a bearing assembly used between the annular tray and platform of the preferred embodiment.

As illustrated in FIG. 3, nested in the upper portion of pedestal 3 is a regular octagonal mounting block 21, horizontally positioned so that the upper surfaces of the pedestal and mounting block are aligned. Mirror unit 7 includes a horizontally extending stationary support plate 23 having a circular periphery and grooves 20 in proximity to the periphery, on the upper face thereof. The bottom edges of mirrors 15 fit into grooves 20 and are captured by the grooves when table 1 is in place. Because adjacent vertically extending edges of mirrors 15 are secured together, mirror unit 7 is captured in grooves 20. Plate 23 has a diameter slightly less than the inner diameter of annular tray 17, in turn having an outer diameter slightly less than the outer diameter of annular groove 27 on the top face of platform 9. The vertical edges at the vertical perimeter of plate 23 and at the inner diameter of groove 27 capture corresponding vertical edges of tray 27 so the tray position is stabilized relative to platform 9 as the tray is rotated about axis 2.

Mirror unit 7 is fixedly attached to pedestal 3 by screws 25 which extend through circular plate 23 into block 21. In shipping, the lower portion of table 1 including pedestal 3, platform 9, and tray 11, and the parts secured thereto, are separated from the upper portion of the table, including mirror unit 7. Mirror unit 7 is assembled at the dispensing site, by screwing screws 25 through platform 23 into block 21. If it is desired to make a massive change in the frames, by replacing one tray 11 with another tray, the tray, previously in use can be lifted above the top of mirror unit 7 and a new tray put in situ.

Sixteen ball bearing assemblies 29 are disposed in two sets of rings 30 and 32, concentric with axis 20; the bearing assemblies of concentric sets 30 and 32 are respectively in proximity to the inner and outer edges of groove 27, in which they are located. Bearing assemblies 29 in sets 30 and 32 are equally spaced about axis 2 so there are corresponding assemblies along the same radii in the two sets and adjacent assemblies in each set are angularly displaced 45° from each other. Bearing assemblies 29 insure smooth rotation of tray 11 and provide sufficient drag to the tray to prevent high speed turning of the tray, so that centrifugal force is limited, to reduce materially the possibility of eyeglass frames being urged against the outer diameter of the tray as it is turned. Each bearing assembly 29 includes a ball bearing 37 having an upper portion in contact with groove 31 on the bottom face of ring 35 that forms the base of tray 17. Groove 31 is formed as a section of a sphere, with a radius of curvature, in vertical cross-section slightly greater than the radius of ball bearing 31. The lower portion of ball bearing 37 extends into cylindrical bore 33, having a diameter approximately the same as ball bearing 37, and a depth such that the bottom of the bearing is spaced from the bottom face of the bore so that the bearing is free to turn in the bore. Substantial lateral movement of bearing 37 is prevented by collar 39 that is secured to groove 27 by screws 41. Collar 39 has a central aperture with the shape of a segment of the center portion of a sphere and a diameter slightly greater than bearing 37 to capture the bearing. As tray 17 is turned, bearing 37 rotates in collar 39 and bore 33 in response to the spin imparted to the bearing by race 31, to provide smooth turning for the tray. Because there is contact between the "forward" side of the bearing, i.e., the side of the bearing that is in the direction tray 11 is turning, substantial drag exists between the bearing and collar. This drag is imparted to tray 11 to reduce the rotational velocity of the tray and provide smooth rotation of tray 11.

From the foregoing, it is apparent that an important feature of the display table of the present invention is that a plurality of customers can be simultaneously seated and serviced at the table. Each customer seating station is opposite one face of mirror unit 7, allowing a customer to view himself in the eyeglass frames selected from rotatable tray 11. Compartments 17 in tray 11 allow a plurality of frames to be quickly and readily selected simply by rotating the tray to bring the desired compartment to the seating station of the customer. A large number of eyeglass frames can be displayed in tray compartment 17. Further, different frame styles can be separated, making customer selection easier.

In a preferred embodiment that was actually constructed and found to be very satisfactory, pedestal 3 had a separation of twenty-four inches between opposite corners, while each of collars 2 and 4 had a height of two inches, with collars 2 and 4 having separations of four and one-half inches and two and one-quarter inches, respectively, between the inner and outer diameters thereof. The bottom face of platform 9 was thirty-one inches above the bottom face of collar 2 and support legs 13 had a radial extent of eighteen inches from the faces of pedestal 3. Platform 9 had inner and outer diameters of twenty-four and sixty inches, respectively, while grooves 27 had inner and outer diameters of twenty-four inches and forty-eight and one-quarter inches to accommodate tray 11, having inner and outer diameters of twenty-four and one-quarter inches and forty-eight and one-quarter inches, respectively. Mirror unit 7 had a height of twenty-three inches and a separation of 22 inches between opposite edges, while plate 23 had a diameter of twenty-three and one-half inches. Plate 23 extended approximately one-eighth inch above the bottom face of tray 17, as did the top face of platform 9.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A merchandise display table for enabling dispensing of eyeglass frames and the like and for enabling plural customers to simultaneously select and view a plurality of frames located on the table comprising:

pedestal means;

mirror means vertically disposed atop said pedestal means, said mirror means including a plurality of faces arranged in a generally circular array;

an annular platform fixedly disposed about said mirror means and an upper portion of said pedestal means, said platform including grooved annular track means formed thereon, said platform being disposed to define a plurality of customer seating stations, said platform including a display space extending beyond the grooved annular track means and on which selected frames and optical instruments can be placed; and an annular display tray member disposed within the area defined by said track means so that the tray member is captured by sides of the grooved track means, said tray member arranged for rotation about said annular platform, said annular tray member having a plurality of compartments for displaying the eyeglass frames.

2. The display table of claim 1 including bearing means disposed in the grooved track means between said tray member and said annular platform.

3. The display table of claim 2 wherein said bearing means includes a plurality of ball bearing assemblies, each of said assemblies being fixedly mounted on the platform and including a ball bearing and a collar fixed to the platform, said collar capturing a central portion of the ball bearing associated with it so lateral movement of the ball bearing is prevented while enabling the ball bearing to rotate in the collar, said tray having an annular race groove into which an upper portion of the ball bearing fits.

4. The display table of claim 3 wherein said tray includes two annular race grooves, said two grooves cooperating with two sets of bearing assemblies located at different radii from an axis of rotation of the tray.

5. The display table of claim 4 wherein the bearing assemblies of the two sets are equi-angularly displaced about the axis.

6. The display table of claim 1 wherein each of said stations is disposed opposite a face of said mirror means.

7. The display table of claim 6 wherein said annular platform has sides formed as a geometrically regular polygon, each side of said polygon defining one of said seating stations, the number of sides of said polygon being equal to the number of said mirror faces.

8. The display table of claim 1 wherein said mirror means is fixed with respect to said annular platform.

9. A merchandise display table for enabling dispensing of eyeglass frames and the like and for enabling plural customers to simultaneously select and view a plurality of frames located on the table comprising:

a pedestal;

a multi-sided mirror unit vertically disposed atop said pedestal and arranged in a generally circular outward facing array;

an annular platform fixedly disposed about said mirror unit and an upper portion of said pedestal, said platform having a polygonal shaped periphery, each face of said polygonal periphery defining a customer seating station, each of said stations disposed opposite a face of said multi-sided mirror unit, said platform further including a grooved annular track formed thereon, said platform including a display space extending beyond the grooved annular track and on which selected frames and optical instruments can be placed; and an annular tray member disposed within the area defined by said annular track so that the tray member is captured by sides of the grooved track, said tray member arranged for rotation about said annular platform, said annular tray member having a plurality of compartments for displaying the eyeglass frames.

10. The display table of claim 9 wherein each of said tray member compartments comprises a sector of said annular tray member.

11. The display table of claim 9 including bearing means disposed in the grooved track between said tray member and said annular platform.

12. The display table of claim 11 wherein said bearing means includes a plurality of ball bearing assemblies, each of said assemblies being fixedly mounted on the platform and including a ball bearing and a collar fixed to the platform, said collar capturing a central portion of the ball bearing associated with it so lateral movement of the ball bearing is prevented while the ball bearing can rotate in the collar, said tray having an annular race groove into which an upper portion of the ball bearing fits.

13. The display table of claim 12 wherein said tray includes two annular race grooves, said two grooves cooperating with two sets of bearing assemblies located at different radii from an axis of rotation of the tray.

14. The display table of claim 13 wherein the bearing assemblies of the two sets are equi-angularly displaced about the axis.

15. The display table of claim 6 wherein the number of sides of said polygonal table member is equal to the number of sides of said multi-sided mirror unit.

16. A mechandise display table for enabling dispensing of eyeglass frames and the like and for enabling plural customers to simultaneously select and view a plurality of frames located on the table comprising:

a base;

a pedestal mounted atop said base;

a multi-sided mirror unit vertically mounted atop said pedestal and arranged in a generally circular outward facing array;

an annular platform fixedly disposed about said mirror unit and an upper portion of said pedestal, said platform having a polygonal shaped periphery, each face of said polygonal periphery defining a customer seating station, each said station disposed opposite a face of said multi-sided mirror, said table member further including a grooved annular track formed thereon, said platform including a display space extending beyond the grooved annular track and on which selected frames and optical instruments can be placed; and an annular tray member disposed within the area defined by said annular track so that the tray member is captured by sides of the grooved track, said tray member arranged for rotation about said annular platform, said annular tray having a plurality of compartments adapted for displaying eyeglass frames.

17. The display table of claim 10 wherein each of said tray member compartments comprises a sector of said annular tray member.

18. The display table of claim 16 including bearing means disposed in the grooved track means between said tray member and said annular platform.

19. The display table of claim 18 wherein said bearing means includes a plurality of ball bearing assemblies, each of said assemblies being fixedly mounted on the platform and including a ball bearing and a collar fixed to the platform, said collar capturing a central portion of the ball bearing associated with it so lateral movement of the ball bearing is prevented while the ball bearing can rotate in the collar, said tray having an annular race groove into which an upper portion of the ball bearing fits.

20. The display table of claim 19 wherein said tray includes two annular race grooves, said two grooves cooperating with two sets of bearing assemblies located at different radii from an axis of rotation of the tray.

21. The display table of claim 20 wherein the bearing assemblies of the two sets are equi-angularly displaced about the axis.

22. The display table of claim 16 wherein the number of sides of said polygonal table member is equal to the number of sides of said multi-sided mirror.

* * * * *